US006186862B1

(12) United States Patent
Fildan

(10) Patent No.: US 6,186,862 B1
(45) Date of Patent: Feb. 13, 2001

(54) BRASSIERE UNDERWIRE WITH EXTENDED SEWING FLANGE

(76) Inventor: Gerhard Fildan, Wohnpart Alte Erlaa, Anton Baumgartner Str. 44, C 4 17 01, A-1232 Vienna (AT)

( * ) Notice: Under 35 U.S.C. 154(b), the term of this patent shall be extended for 0 days.

(21) Appl. No.: 09/363,059

(22) Filed: Jul. 29, 1999

(51) Int. Cl.[7] ..... A41C 3/00
(52) U.S. Cl. ..... 450/41; 450/51
(58) Field of Search ..... 450/41, 45, 46, 450/47, 48, 51, 52

(56) References Cited

U.S. PATENT DOCUMENTS

| | | | | |
|---|---|---|---|---|
| 1,474,190 | | 11/1923 | Fox . | |
| 3,030,633 | | 4/1962 | Chalfin . | |
| 3,035,584 | | 5/1962 | Menkel . | |
| 3,531,807 | | 10/1970 | Devito . | |
| 3,562,802 | | 2/1971 | Avis . | |
| 3,747,606 | * | 7/1973 | Tareau | 450/48 |
| 4,133,316 | | 1/1979 | Schwartz . | |
| 4,153,062 | | 5/1979 | Delet . | |
| 4,201,220 | | 5/1980 | Rowell . | |
| 4,235,240 | * | 11/1980 | Cousins | 450/52 |

* cited by examiner

*Primary Examiner*—Gloria M. Hale
(74) *Attorney, Agent, or Firm*—Herbert Dubno

(57) ABSTRACT

A brassiere underwire is formed with a sewing flange only along the outer side thereof and extending from locations spaced from the tips continuously around the outer side of the underwire bight. At a central zone flexibility can be increased by providing holes in the sewing flange and/or by making the sewing flange narrower. The underwire is stitched through the sewing flange in forming the brassiere.

13 Claims, 3 Drawing Sheets

BRASSIERE UNDERWIRE WITH EXTENDED SEWING FLANGE

FIELD OF THE INVENTION

The present invention relates to a brassiere underwire having an extended sewing flange along the outer side of the underwire and to a brassiere having such underwires supporting the cups thereof.

BACKGROUND OF THE INVENTION

Brassiere underwires have been provided heretofore in a variety of configurations (see especially U.S. Pat. Nos. 4,201,220; 4,153,062; 4,133,316; 3,562,802 and 3,035,584).

In all of these publications, underwires are described which are of substantially uniform cross section and thickness over the entire length of the generally U-shaped underwire from tip to tip thereof.

Brassiere underwires form stays which impart, shape to or retain the shape of the cup of the brassiere and are generally received in a tubular fabric formation along the lower edge of the cup. That tubular formation or pocket can be formed by stitching. To prevent undesired movement of the underwire stay, it is known to form the stay with sewing flanges which can easily be pierced by a sewing needle and which allow the stay to be fixed in that tubular pocket. Reference can be had, in this regard, to U.S. Pat. No. 4,235,240 which provides such sewing flanges both along the inner and outer sides of the U-shaped underwire or forms the sewing flange so that it extends over the entire length of the underwire. Neither arrangement has been found to be fully satisfactory. The flanges on both the inner and outer sides of the underwire, even where flexibility is promoted by notching those flanges or making them discontinuous, have been found to make the underwire incapable of bending out of its plane to a sufficient degree and where the flanges extend to the tips of the underwire, the underwire has proved to be uncomfortable to the wearer. For that reason, sewing flanges along the underwire have not been found to be acceptable heretofore.

OBJECTS OF THE INVENTION

It is, therefore, the principal object of the present invention to provide an underwire which is free from the drawbacks of underwires having flanges on the inner and outer sides of the wire or flanges which extend to the tips thereof and hence render the underwire excessively stiff and incapable of conforming to the contours of the body.

Another object of the invention is to provide an underwire which can be effectively stitched into a brassiere and yet is free from the drawbacks of the earlier underwires described.

It is also an object of this invention to provide an improved brassiere of the underwire type.

SUMMARY OF THE INVENTION

These objects and others which will become apparent hereinafter are attained, in accordance with the invention in an underwire which is generally U-shaped, is formed with a sewing flange along the bight and is spaced from the ends of the wire and is thinner than the wire from which is projects and wherein that sewing flange is tapered inwardly toward each wire end.

According to a feature of the invention, the underwire, which is free from sewing flanges or discontinuities along the inner side thereof, has its sewing flange so formed that it is of greater flexibility at approximately the center of the sewing flange. The greater flexibility can be achieved by one or more holes formed in the flexible zone at the center of the sewing flange and/or by making the sewing flange narrower at this central zone.

More particularly, an underwire stay for a brassiere can comprise a generally U-shaped wire of substantially uniform thickness and width having ends formed with rounded tips and a curved bight between the ends, and a sewing flange thinner than the wire and projecting outwardly from the bight over a portion of the length of the wire spaced from the tips, extending continuously along the bight and tapering tangentially to the ends, the wire having a continuously curved inner edge.

A brassiere provided with such underwires can comprise:

a pair of brassiere cups interconnected at a front of the brassiere and provided with straps for supporting the brassiere cups, each of the cups being formed with a respective tubular sleeve beneath the respective cup;

a respective underwire stay received in each of the sleeves, each of the underwire stays comprising a generally U-shaped wire of substantially uniform thickness and width having ends formed with rounded tips and a curved bight between the ends, and a sewing flange thinner than the wire and projecting outwardly from the bight over a portion of the length of the wire spaced from the tips, extending continuously along the bight and tapering tangentially to the ends, the wire having a continuously curved inner edge; and stitching through each of the sewing flanges securing each sewing flange to secure each underwire stay to the respective cup.

When the underwires are formed integrally from a synthetic resin material, both the wire and the flange are provided in one piece, e.g. from a polyamide. Alternatively, the wire can have a metal core covered by a plastic sheath and, in that case, the flange is formed unitarily with the plastic sheath.

BRIEF DESCRIPTION OF THE DRAWING

The above and other objects, features, and advantages will become more readily apparent from the following description, reference being made-to the accompanying drawing in which.

SPECIFIC DESCRIPTION

Figure 1:
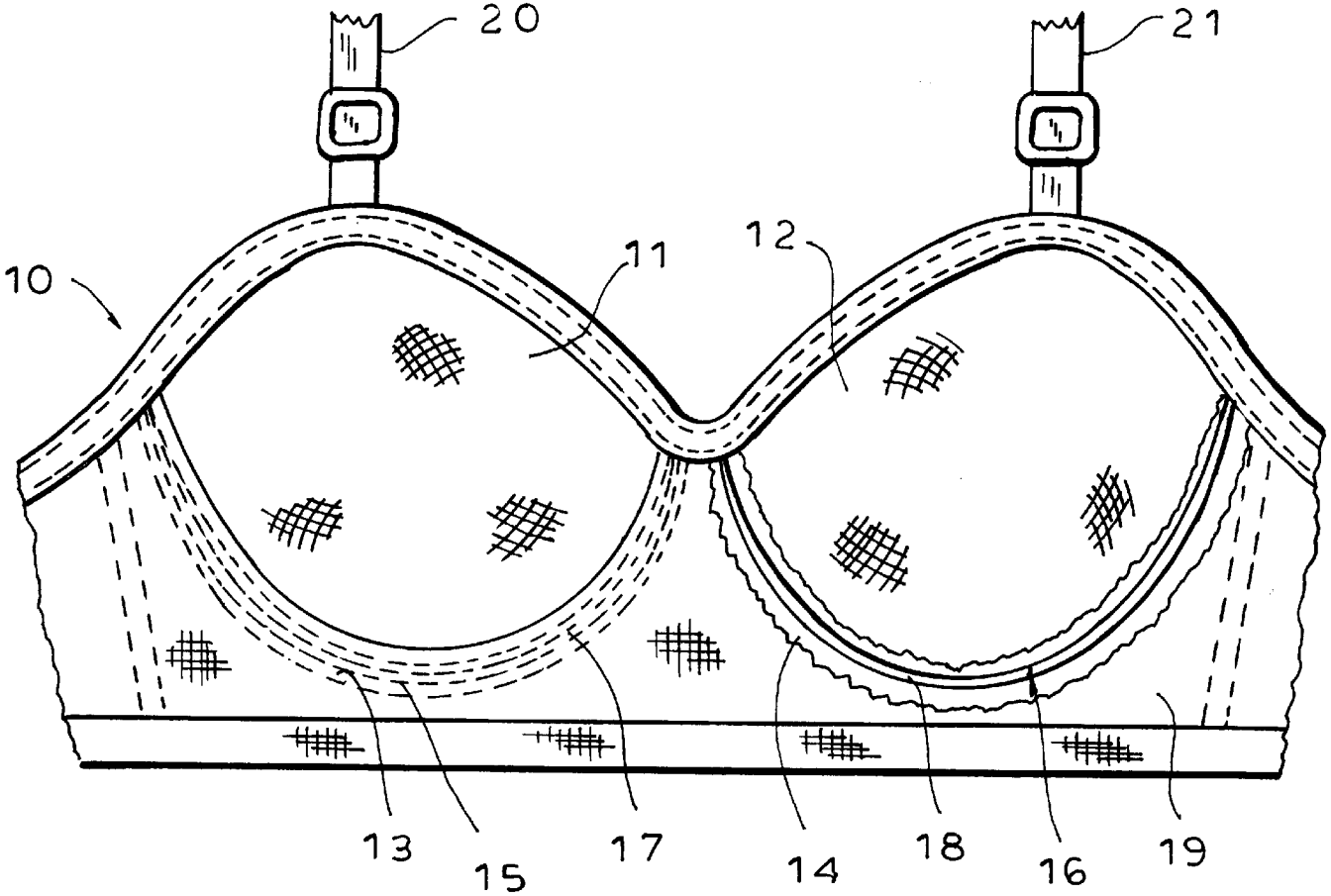
FIG. 1 is a fragmentary elevational view, partly broken away, of a brassiere provided with the improved underwire of the present invention.

As can be seen from FIG. 1, a brassiere 10 may have fabric cups 11 and 12, along the underside of which, tubular pockets 13 and 14 can be provided in which respective underwires 15 and 16 can be disposed. At least one row of stitching represented at 17 in FIG. 1 can pass through the sewing flange of each underwire, the sewing flange being shown for the underwire 16 at 18. The underwire characteristics are best seen from FIGS. 2 to 4.

The brassiere can have a fabric body 19 which can have its ends connected at the back of the wearer by conventional hook and eye fasteners. The shoulder straps are seen at 20 and 21.

Figure 2:
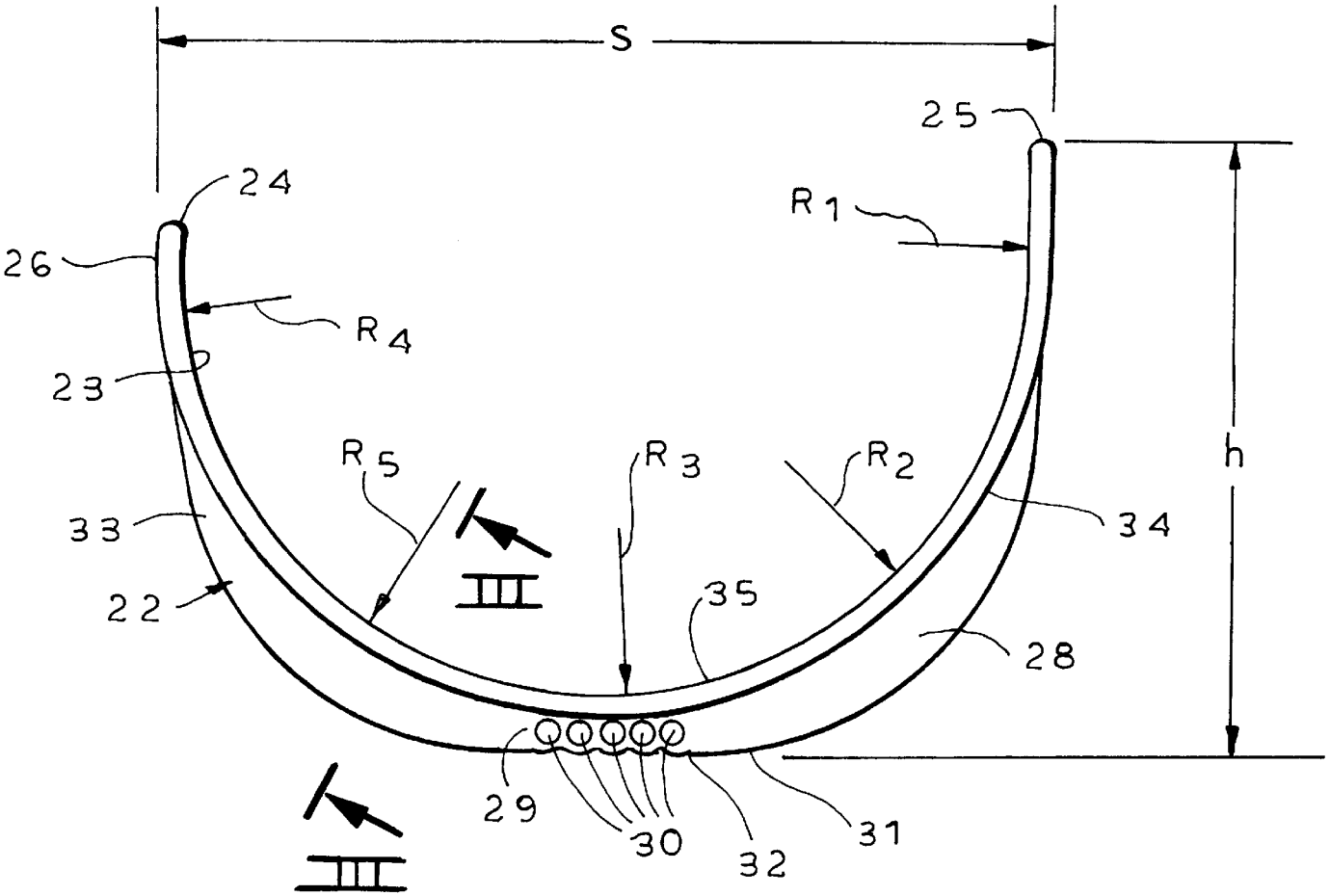
FIG. 2 is an elevational view of an underwire according to the invention.

From FIG. 2 it will be apparent that the underwire, such as the underwire 15 or 16 can comprise a U-shaped body 22 having a wire portion 23 of uniform thickness t and width w (see also FIG. 3) over its entire length between tips 24 and 25 which are rounded at the ends of the wire portion 23.

Commencing inwardly of the ends 26 and 27, along only the outer side of the wire portion 23, is a thinner sewing flange 28 of a thickness f (FIG. 3) which may be between 0.2 t and 0.6 t and is preferably about 0.4 t. In a particular case in which t is about 2 mm, the thickness f can be about 0.8 mm. The thickness f should be sufficiently small as to permit piercing of the sewing flange 28 by the sewing needle used to stitch the underwire in the tubular pocket below the brassiere cup.

The sewing flange 28 has at the center thereof a flexible zone 29 which may be formed by a row of holes 30 whose diameters can approximately equal the width of the sewing flange in this region. The flexible zone 29, moreover, is provided with a rectilinear edge 31 which may have undulations 32 in the region of the holes 30. The holes 30 pass completely through the sewing flange.

To either side of the flexible zone 29, the sewing flange may widen and in its widest region may have a width between 5 and 15 times the thickness t, preferably about 10 time the thickness t, e.g. around 20 mm.

The width V can be between 1.4 and 5 times t and preferably is about 3 mm in the case in which t is about 2 mm.

As can be seen from FIG. 2, moreover, the sewing flange 28 tapers at 33 and 34 toward the ends 26 and 27 respectively.

The inner side 35 of the wire portion 23 is a continuous curve with no discontinuities. The radius of curvature can vary, however, at different locations. For example, at the end proximal to the center of the brassiere, the radius of curvature $r_1$ may be about 90 mm whereas the radius of curvature $r_2$ between this region and the central zone may be about 50 mm while in the central zone, the radius over curvature $r_3$ can be about 70 m mm. At the region proximal to the outer end of the wire, i.e. the end remote from the center of the brassiere and approaching the arm of the wearer, the radius of curvature r4 may be about 80 mm while the radius of curvature $R_5$ between this region and the center region can be about 52 mm.

The values given are for a case in which the overall height h of the underwire is say 77.7 mm and the spread between the ends of the wire, represented at s, is about 115 mm. Different cup sizes of a brassiere will require different underwire sizes and, by and large, proportions are maintained in the dimensions given. It has been found to be advantageous to round the cross section of the underwire as well and the radius of curvature $r_6$ can be about 1 mm as is the radius $r_7$. The radius of curvature $r_8$ for the sewing flange is generally 0.4 mm in this underwire.

Figure 3:
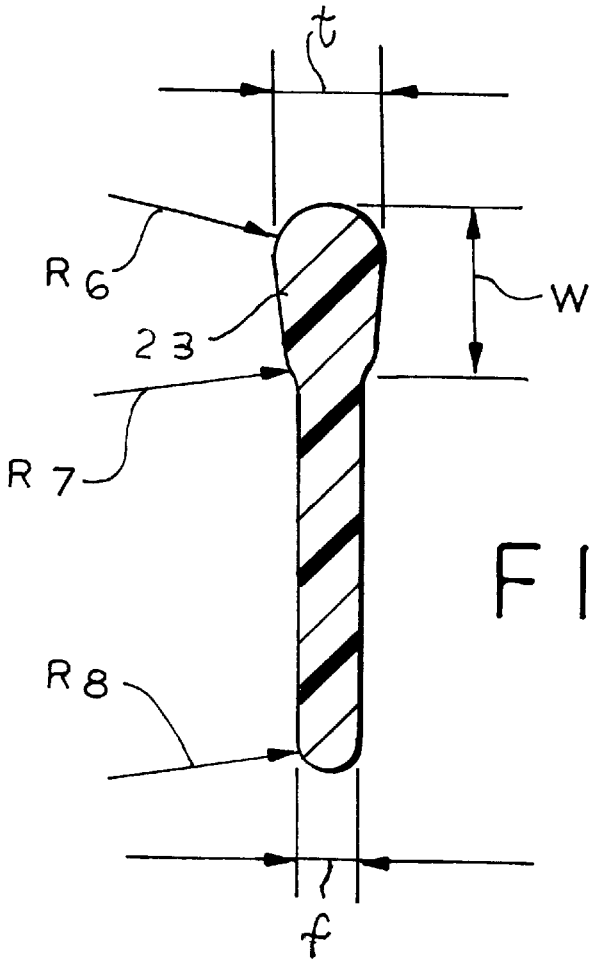
FIG. 3 is a cross section taken along the line III—III of FIG. 2.

The underwire is composed of polyamide (nylon) and is formed, in the embodiment of FIGS. 2 and 3 in one piece by injection molding.

Figure 4:
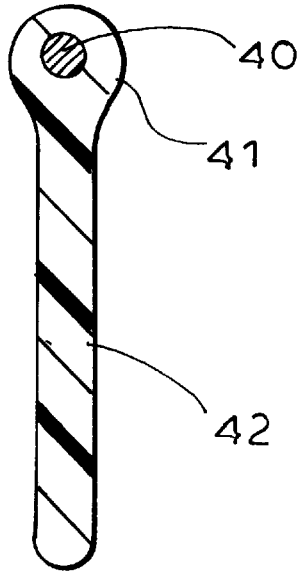
FIG. 4 is a cross sectional view of another embodiment of the underwire of the invention.

As can be seen from FIG. 4, however, the underwire can have a metal core 40 around which a polyamide sheath 41 is formed, the sheath being in one piece with the sewing flange 42.

I claim:

1. An underwire stay for a brassiere, consisting of a generally U-shaped wire of substantially uniform thickness and width having ends formed with rounded tips and a curved bight between said ends, and a single sewing flange thinner than said wire and projecting outwardly from said bight over a portion of the length of said wire spaced from said tips, extending continuously along said bight and tapering tangentially to said ends, said wire having a continuously curved inner edge, said bight having a center, said flange having a flexible zone formed by at least one hole at said center.

2. The underwire stay defined in claim 1 wherein said wire and said sewing flange are formed integrally in one piece of a synthetic resin material.

3. The underwire stay defined in claim 1 wherein said wire has a metal core covered by a plastic sheath, said flange being formed in one piece with said plastic sheath.

4. The underwire stay defined in claim 1 wherein said flange is formed by a row of holes at said center.

5. The underwire stay defined in claim 3 wherein said flexible zone is a narrow portion of said flange, said flange widening on opposite sides of said flexible zone.

6. The underwire stay defined in claim 1 wherein said sewing flange has a rectilinear edge along a side thereof turned away from said wire.

7. A brassiere comprising:

a pair of brassiere cups interconnected at a front of said brassiere and provided with straps for supporting said brassiere cups, each of said cups being formed with a respective tubular sleeve beneath the respective cup;

a respective underwire stay received in each of said sleeves, each of said underwire stays comprising a generally U-shaped wire of substantially uniform thickness and width having ends formed with rounded tips and a curved bight between said ends, and a sewing flange thinner than said wire and projecting outwardly from said bight over a portion of the length of said wire spaced from said tips, extending continuously along said bight and tapering tangentially to said ends, said wire having a continuously curved inner edge free from a sewing flange, said flange having a central flexible zone at a center thereof between ends of said flange, said flexible zone being a narrow portion of the respective flange, said flanges widening on opposite sides of said flexible zone; and stitching through each of said sewing flanges securing each sewing flange to secure each underwire stay to the respective cup.

8. The brassiere defined in claim 7 wherein each of said wires and the respective sewing flange are formed integrally in one piece of a synthetic resin material.

9. The brassiere defined in claim 7 wherein each of said wires has a metal core covered by a plastic sheath, said flanges being formed in one piece with the respective plastic sheath.

10. The brassiere defined in claim 7 wherein said bight of each stay has a center, each of said flanges having a respective flexible zone at the respective center.

11. The brassiere defined in claim 10 wherein each of said flexible zones is formed by at least one hole in the respective flange at said center thereof.

12. The brassiere defined in claim 11 wherein said zones are formed by respective rows of holes at said centers.

13. The brassiere defined in claim 8 wherein each of said sewing flanges has a rectilinear edge along a side thereof turned away from said wire.

* * * * *